US005299499A

United States Patent [19]

Christophe et al.

[11] Patent Number: 5,299,499

[45] Date of Patent: Apr. 5, 1994

[54] INFRARED DETECTION DEVICE

[75] Inventors: Bernard M. E. Christophe, Paris; Roger Muller, Deuil-la-Barre, both of France

[73] Assignee: Societe Anonyme de Telecommunications, Paris, France

[21] Appl. No.: 999,671

[22] Filed: Dec. 30, 1992

Related U.S. Application Data

[63] Continuation of Ser. No. 271,785, Jun. 3, 1981, abandoned.

[30] Foreign Application Priority Data

Aug. 8, 1980 [FR] France ..... 80 17555

[51] Int. Cl.[5] ..... F42C 13/02

[52] U.S. Cl. ..... 102/213

[58] Field of Search ..... 102/213, 384; 244/3.16

[56] References Cited

U.S. PATENT DOCUMENTS

| | | | |
|---|---|---|---|
| 2,882,823 | 4/1959 | Menke et al. | 102/213 |
| 3,621,784 | 11/1971 | Mundie et al. | 102/213 |
| 3,719,149 | 3/1973 | Masin | 102/213 |
| 4,098,191 | 7/1978 | Bagwell et al. | 102/213 |

FOREIGN PATENT DOCUMENTS

| | | |
|---|---|---|
| 2233135 | 1/1974 | Fed. Rep. of Germany . |
| 1450968 | 9/1976 | United Kingdom . |

*Primary Examiner*—Ian J. Lobo

*Attorney, Agent, or Firm*—Bacon & Thomas

[57] ABSTRACT

Infrared detection device carried by a missile falling to earth and rotating about its axis with a given inclination, said device being intended to trigger off firing of the missile when it detects a source of infrared emission of predetermined type, the device comprising at least one infrared detector sensitive to the infrared emission of said sources and an amplifier device connected to the output of the detector.

3 Claims, 2 Drawing Sheets

INFRARED DETECTION DEVICE

This application is a continuation of application Ser. No. 06/271,785, filed Jun. 3, 1981 now abandoned.

The present invention relates to an infrared detection device carried by a missile falling to earth, rotating about its axis at a given inclination, said device being adapted to trigger off firing of the missile when it detects a source of infrared emission of predetermined type.

Missiles concerned at present are, in particular, anti-tank shells released from a craft.

The combination of the falling movement of the missile and its rotation about the falling axis with a constant inclination allows a circular zone to be surveyed whose diameter depends on the altitude at which surveying is begun and on the angle of inclination.

Firing must, of course, be triggered off only when a source of the sought type is detected. Now, infrared sources of various types may be located in the scanned zone, and may act as decoys triggering off untimely firing.

It is an object of the present invention to eliminate detections of sources other than the sources sought, in order to avoid untimely firing of the missile.

The device according to the invention, which comprises at least one infrared detector sensitive to the infrared emission of said sources and an amplifier device connected to the output of the detector, is characterized in that it comprises a threshold device which stops the signal issuing from the amplifier device if said signal is lower than a threshold which varies substantially as $1/d^2$, d being the distance of the missile to the ground, and a means for inhibiting firing in the case of saturation of the amplifier device.

As only sources of specific type are of interest, the emission level in the spectral band of the detector, and therefore the level of the output signal of the detector corresponding to the detection of a source of this type, are known approximately. The invention then defines a level "window" outside which the detection signals are not taken into account.

The lower limit of this window, constituted by the above-mentioned threshold, varies inversely with respect to the square of the distance d to the ground. This enables the threshold to be adapted to the mean level of the detection signal, being given that the radiation of an infrared source propagates in accordance with a $1/d^2$ relation.

To define the upper limit, the zone of linearity of the amplifier device is arranged to cover the level range expected for a signal corresponding to the detection of a source of the sought type. Therefore, saturation of the amplifier device corresponds to detection of a parasitic source of intense radiation, and taking into account the saturation, the influence of these parasitic sources may be eliminated.

Two detectors sensitive in offset spectral bands, as well as means for comparing the output signals of the detectors and for inhibiting firing if the result of the comparison does not fulfill a determined condition, are advantageously provided.

Use is made of the fact of knowing approximately the emission spectrum of the said hot spots. A relation may therefore be established between the levels of the signals corresponding to offset spectral bands, and it can be checked whether this relation is respected. In the contrary case, the source detected is a parasitic source.

The invention will be more readily understood on reading the following description with reference to the accompanying drawings, in which.

Figure 1:
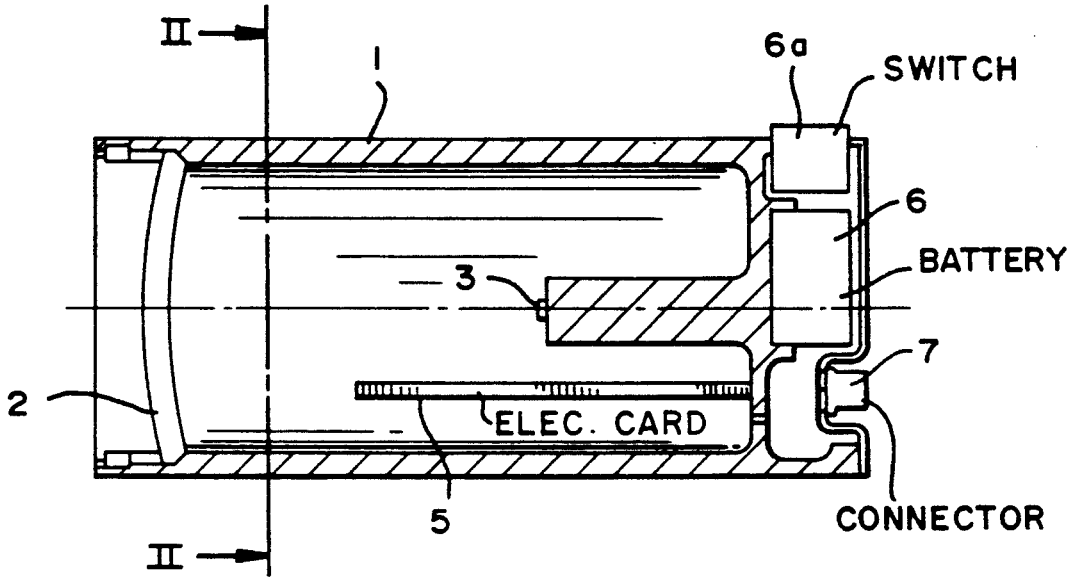
FIG. 1 shows the detection device in axial section.
Figure 2:
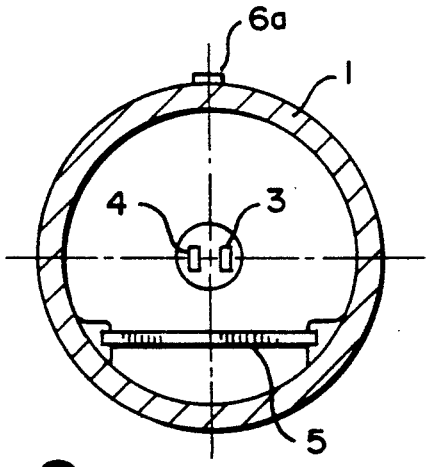
FIG. 2 shows the detection device in transverse section, along the plane II—II of FIG. 1.

Referring now to the drawings, the device shown therein is fixed on a missile of the anti-tank shell type released from a craft and provided with a parachute so as to drop at constant velocity. The missile is designed to rotate, whilst dropping, about the vertical at a constant velocity, for example 10 revolutions per second, and is inclined by a given angle, equal for example to 30°, with respect to the vertical.

The device comprises a tubular housing 1 provided with an inlet lens 2 transparent to the radiations to be detected and two detectors 3 and 4 placed in the vicinity of the axis of the lens 2. The detector 3 is sensitive in the 1.8–2.5 μm band, and is made of PbS, and detector 4 is sensitive in the 3–5 μm band and is made of PbSe. Although this does not appear in the drawing, the detectors 3 and 4 are placed in planes offset along the axis of lens 2 to take into account the fact that the focal distance of the lens 2 varies with the wave length of the radiation in question.

Taking into account the falling movement of the missile and its rotation about the vertical with a constant inclination, the projection on the ground of the optical axis of the device describes a spiral. Taking into account the field of the lens 2, the device thus ensures surveying of a circular portion of ground the diameter of which is a function of the altitude at which surveying begins.

The device comprises the electronics associated with the detectors 3 and 4, symbolised by the card 5, which will be described with reference to FIG. 3, a battery 6 for supplying power the circuits, a switch 6a and a connector 7 which ensures connection with the members for controlling the missile. The detection device begins to function only from reception of an order from the missile, emitted at a predetermined altitude, which acts on the switch 6a. In the other sense, the device addresses a firing order to the missile when an infrared source is detected the emission of which corresponds to predetermined criteria and may consequently be identified as being a tank, with a very low risk of error.

Figure 3:
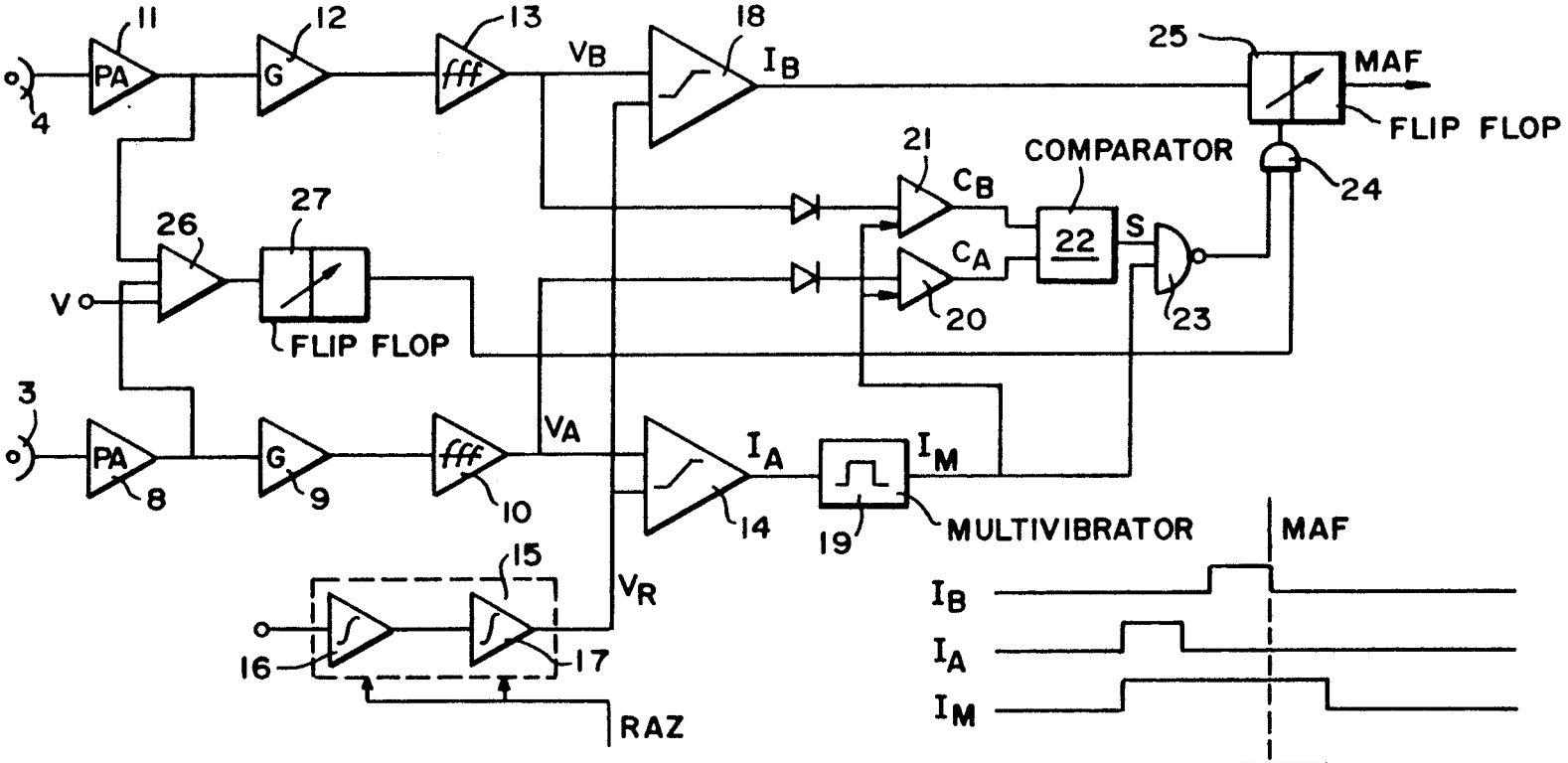
FIG. 3 is the diagram of the circuit connected to the detectors.

FIG. 3 shows the PbS detector 3 and the PbSe detector 4. Due to their angular offset with respect to the optical axis, the two detectors are not illuminated at the same time by a source, the PbS detector 3 being illuminated before the PbSe detector 4.

The output signal of the detector 3 is applied to a channel A comprising a preamplifier 8, a peak-chopping amplifier 9 and a low-pass filter 10. Similarly, a channel B comprising a preamplifier 11, a peak-chopping amplifier 12 and a low pass filter 13 is associated with the PbSe detector 4.

The voltage signal $V_A$ issuing from channel A is applied to a comparator 14, which delivers a square pulse signal $I_A$ if the voltage $V_A$ is greater than a threshold voltage $V_R$ furnished by a generator 15.

This generator comprises two integrators 16 and 17 in cascade initialization of which is controlled by a pulse RAZ which is applied when the switch 6a is actuated by the above-mentioned order emitted by the missile. The generator 15 therefore produces, from the constant voltage which is applied thereto, a voltage having a term proportional to $t^2$, t being the time having lapsed after sending the pulse RAZ.

As the missile drops at constant velocity, the distance that it covers is proportional to time and it may be admitted with sufficient approximation that the altitude of the missile, and therefore the distance of the detector to the ground, are proportional to 1/t.

Consequently, the threshold voltage $V_R$ furnished by the generator 15 varies approximately as $1/d^2$, i.e. as the level of the detection signal of a given source. The threshold voltage is thus permanently adapted to the level of the signal furnished by the detector.

The signal of channel B is similarly compared with the threshold voltage $V_R$ in a comparator 18, which delivers a square pulse signal $I_B$ if the voltage $V_B$ is greater than $V_R$.

Figure 4:
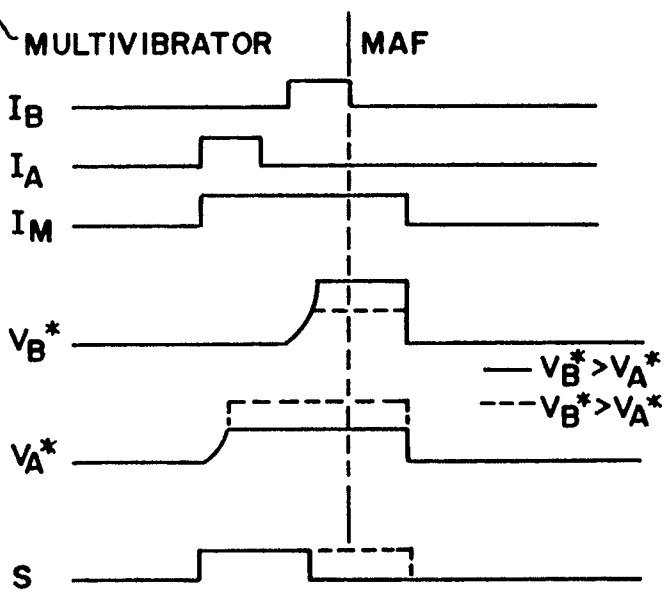
FIG. 4 is a timing chart corresponding to a part of the circuit of FIG. 3.

As shown in FIG. 4, the signal $I_A$ is in advance over signal $I_B$, for the reason indicated hereinabove, associated with the arrangement of the detectors 3 and 4.

The pulse $I_A$ is applied to a monostable multivibrator 19 which furnishes a square pulse signal $I_M$ of a duration such that its trailing edge is to the rear of the trailing edge of signal $I_B$.

The signal $I_M$ allows two peak detectors 20 and 21 to function, which respectively receive the signals from channels A and B issuing from the filters 10 and 13. The peak detectors 20 and 21 measure the peak values of these signals and store them up to the trailing edge of the signal $I_M$. The output signals $C_A$ and $C_B$ of the detectors 20 and 21 are applied to a comparator unit 22 comprising adjustable dividers at its input. The comparator unit 22 thus compares the voltages $V_A'$ and $V_B'$ derived from the signals $C_A$ and $C_B$ and different from the above voltages $V_A$ and $V_B$ proportional to the latter, and its output S is in logic state 1 if $V_A' > V_B'$ and in logic state 0 if $V_B' > V_A'$.

The emission spectrum of the sources to be detected, tanks in the present case, is such that $V_B' > V_A'$, and if this condition is not fulfilled, the detected source must be considered as parasitic.

The signals $V_A'$ and $V_B'$ shown in solid lines in FIG. 4 fulfill this condition, whilst the signals shown in broken lines correspond to the detection of a parasitic source. The output S of the comparator unit 22 is shown in both cases in FIG. 4.

The output of the comparator unit 22 and that of the monostable multivibrator 19 are applied to an inverted AND gate 23 which is therefore in the 0 state during the duration of signal $I_M$ if the source detected is a parasitic source.

The output of the gate 23 is connected via an AND gate 24 to a bistable flip flop 25 which is connected to the output of the comparator 18 and which delivers an order MAF to fire the missile if the voltage $V_B$ is greater than the threshold and if the gate 24 is in state 1.

The trailing edge of the signal $I_B$ thus serves as synchronisation for controlling firing.

The other input of the gate 24 is connected to a saturation detector comprising a comparator 26 whose inputs are connected to the outputs of the preamplifiers 8 and 11 and whose output is connected to a bistable flip flop 27. If one of the output voltages of the preamplifiers becomes greater than a threshold corresponding to saturation, the output of the flip flop 27 passes to state 0 and blocks gate 24. Parasitic sources of high intensity are thus prevented from being taken into account.

What we claim is:

1. Infrared detection device carried by a missile falling to earth and rotating about its axis with a given inclination, said device being intended to trigger off firing of the missile when it detects a source of infrared emission of predetermined type, the device comprising at least one infrared detector sensitive to the infrared emission of said source and an amplifier device connected to the output of the detector, characterized in that said detection device further comprises a threshold device which stops the signal issuing from the amplifier device if said signal is lower than a threshold which varies substantially as $1/d^2$, d being the distance of the missile to the ground, and a means for inhibiting firing in the case of saturation of the amplifier device.

2. The device of claim 1, wherein, if the missile drops at constant velocity, the threshold is furnished by a generator comprising two integrators in cascade and thus varies as $t^2$, t being the duration of integration.

3. The device of claim 1, wherein two detectors, sensitive in offset spectral bands, as well as means for comparing the output signals of the detectors and for inhibiting firing if the result of the comparison does not fulfill a predetermined condition, are provided.

* * * * *